United States Patent [19]

Kraemer

[11] Patent Number: 4,878,039

[45] Date of Patent: Oct. 31, 1989

[54] APPARATUS AND METHOD FOR PROVIDING A STRAIN-RESISTANT RESISTANCE TEMPERATURE DETECTOR

[75] Inventor: Carolyn Kraemer, Georgetown, Tex.

[73] Assignee: Weed Instruments Co., Inc., Round Rock, Tex.

[21] Appl. No.: 115,347

[22] Filed: Nov. 2, 1987

[51] Int. Cl.[4] ..... H01C 3/04

[52] U.S. Cl. ..... 338/26

[58] Field of Search ..... 338/25, 26; 219/528, 219/529

[56] References Cited

U.S. PATENT DOCUMENTS

| | | | |
|---|---|---|---|
| 3,537,053 | 10/1970 | Snoberger et al. | 338/26 |
| 3,760,319 | 9/1973 | Kawazoe | 338/26 |
| 3,852,570 | 12/1974 | Taylor | 219/528 |
| 4,382,246 | 5/1983 | Hansson et al. | 338/26 |

*Primary Examiner*—Clifford C. Shaw
*Assistant Examiner*—M. M. Lateef
*Attorney, Agent, or Firm*—J. Nevin Shaffer, Jr.

[57] ABSTRACT

A strain-resistant resistance temperature element for a temperature averaging sensor and apparatus for producing same. Highly sensitive thin metal wire, typically of platinum, is attached to both sides of a high temperature, pliable yet stretch/strain resistant tape. A somewhat wider tape of similar description is then applied to both sides of the tape containing the sensor wire. As a result, a highly pliable, yet stretch/strain resistant resistance temperature detector is provided. The major advantages of the invention being that the resistance temperature detector (RTD) of the instant invention is provided substantial strain relief and, therefore, will overcome the problems of prior art sensors, which broke 100% of the time after a minimal period of use. Further, the RTD of the present invention may be pulled through the plastic tubing used to shelter the RTDs from the material being measured, without fear of breaking.

8 Claims, 2 Drawing Sheets

APPARATUS AND METHOD FOR PROVIDING A STRAIN-RESISTANT RESISTANCE TEMPERATURE DETECTOR

BACKGROUND OF THE INVENTION

This invention relates to an improved strain-resistant resistance temperature detector (RTD) designed to measure the average, relative temperature of a given medium along the length of the sensor.

A wide variety of sensors utilized for the purpose of measuring temperature are known in the prior art. In particular, the use of a platinum wire encased in a hollow plastic tube, has proved useful in determining the average, relative temperature of a given medium along the length of the sensor. As a result, this construction has proved useful, among other things, in testing of underground storage tanks. In a typical embodiment, a length of platinum wire is encased in an extensible, cylindrical helical coil of plastic tubing which has been immersed in and extended over the height of liquid, the temperature of which is being measured. The plastic tubing of the helical coil, of one particular invention, has more coil turns at its center than at its ends, so that when the coil extends over the diametrical height of a cylindrical tank, the proportion of coil turns remains constant to provide proportionately more sensing wire at the center of the tank where the volume is greatest and a decreasing amount of sensing wire away from the tank center towards the top and bottom of the tank to match the decreasing volume profile. Horner, U.S. Pat. No. 4,618,268 describes such a device. Further, the Horner Patent utilizes a weight attached to the closed end of the coil so that as the helical coil is introduced into the tank, the coil automatically extends or stretches by gravity to match the tank diameter. Of necessity, by this design, the introduction and reintroduction of the device into a tank, for purposes of measuring, will cause the helical coil to stretch and contract again and again.

A critical drawback to the functional utility of the Horner invention and similar devices of the prior art, is that the platinum wire, which will typically be 0.002 inches in diameter, and any other wires utilized for the same purpose, will strain and break 100% of the time due to the stretching of the helical coil of plastic surrounding the sensor wire.

A further drawback of the temperature sensors known in the art, is that simply attempting to introduce the wire into the plastic helical coil often results in the wire breaking. Thus, there is a need in the art for providing a resistance temperature detector designed to measure the average, relative temperature of a given medium along the length of the sensor that is strain resistant. Further, there is a need in the art for providing a sensing wire that is resistant to breakage while the wire is being introduced into the shielding coil.

It, therefore, is an object of this invention to provide an improved strain-resistant resistance temperature element for use in a temperature averaging sensor which can withstand repeated stretching and compressing of the helical coil of plastic tubing in which the element is contained and further which can be easily inserted into the helical coil shield.

SHORT STATEMENT OF THE INVENTION

The improved strain-resistant resistance temperature element of the present invention is intended for use in a temperature averaging sensor which utilizes a helical coil shield in which the element is contained. The element consists of a length of wire with a known electrical resistance versus temperature characteristic wound on a flexible, non-elastic substrate which is then further encapsulated by a second flexible, non-elastic substrate.

The strain-resistant resistance temperature element of the present invention is produced on an apparatus which includes a primary tape winder and primary tape guides connected with the primary tape winder for guiding a first tape from the primary tape winder. The tape serves as a flexible, non-elastic substrate.

A secondary tape winder, containing a second tape, is also provided. Again, the secondary tape serves as a flexible, non-elastic substrate. Further, a sensor wire dispenser, connected with the secondary tape winder, is provided so that the sensor wire is deposited upon or attached to the second tape. A wire feeding means directs the sensor wire, which has been deposited on the second tape, through a set of rollers that results in a sandwiching of the sensor wire and tape between two pieces of the first tape.

The tape substrate of the preferred embodiment is a high temperature mylar product such as "kapton" produced by the DuPont Company. As a result of this invention, the relatively fragile, extremely thin diameter sensing wire typically utilized in the prior art is protected against breaking as a result of the stretching and compressing of the coiled helical covering within which the wire is located. Additionally, the device of the present invention enables a person to actually pull this fragile sensor wire through the helical coil without fear of breaking.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
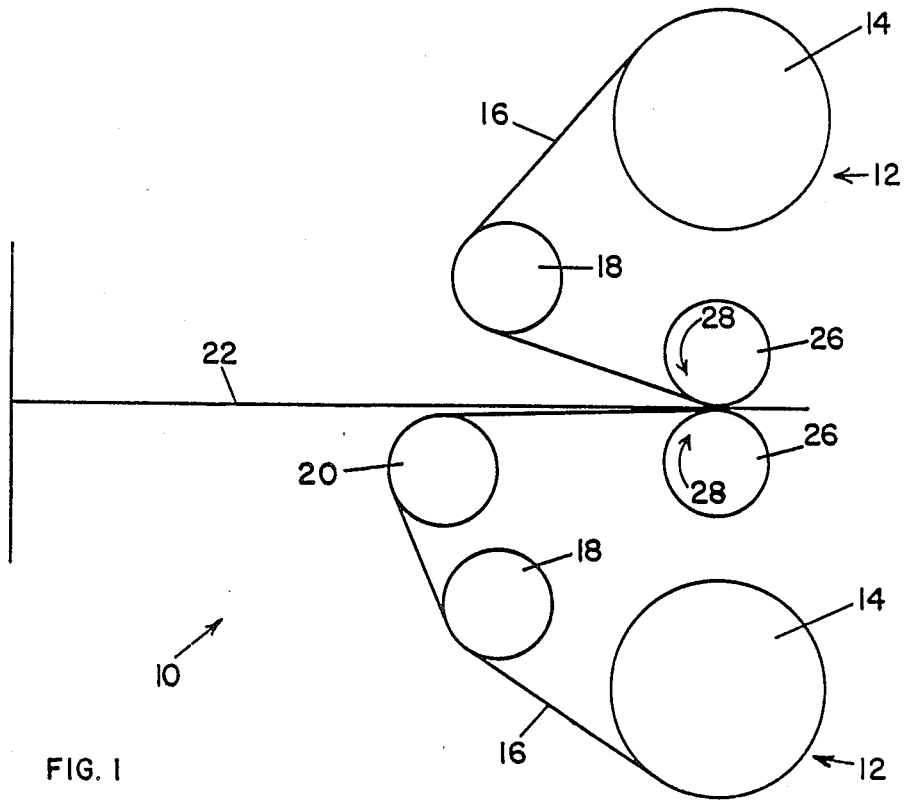
FIG. 1 is a top view of a preferred embodiment of the strain resistant RTD mechanism of the present invention.

The preferred embodiment of the present invention is illustrated by way of example in FIGS. 1–6. With specific reference to FIG. 1, apparatus 10 includes primary tape winder 12 comprised of a pair of oppositely positioned winding spools 14 wrapped with first tape 16. The free ends of first tape 16 are passed to initial tape guides 18. From there, at least one additional tape guide 20 is utilized to align the first tape correctly with the rest of the device as is discussed hereafter.

FIG. 1 also shows second tape 22 upon which sensor 24 (not shown) has been deposited on both sides of second tape 22.

FIG. 1 also shows feed rollers 26. Directional arrows 28 illustrate that first tape 16, from oppositely positioned winding spools 14, is rolled on top of second tape 22, with sensor 24 (not shown), thereby sandwiching second tape 22 and sensor wire 24 on both sides of second tape 22 between an outer layer of first tape 16. Wire 24 is deposited on to second tape 22 by any means known in the art such as by use of adhesives. Similarly, first tape 16 is attached to, deposited over, second tape 22 by ordinary means known in the art, such as by adhesive.

Figure 2:
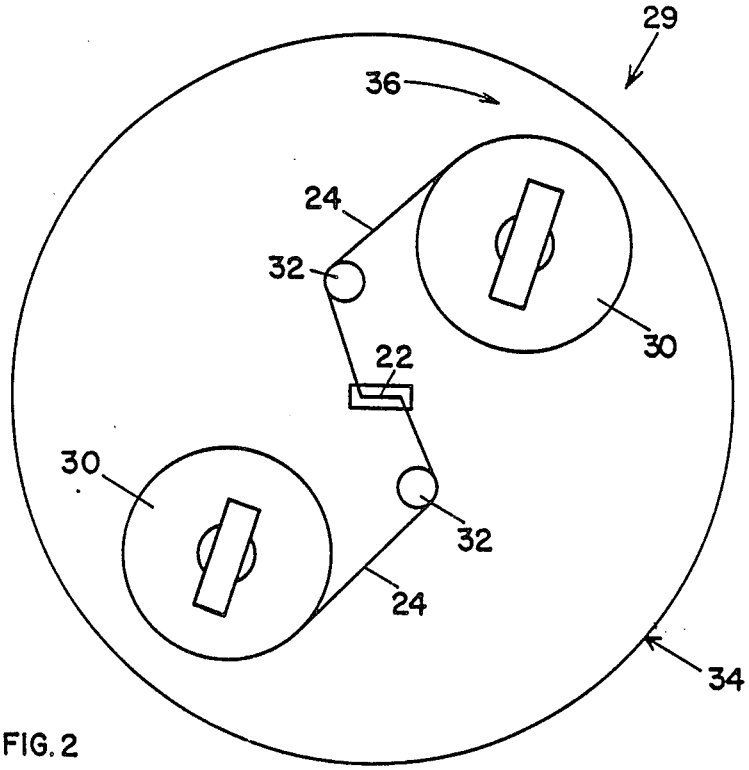
FIG. 2 is top view of a sensor wire dispenser.

Referring now to FIG. 2, sensor wire dispenser 29 comprises sensor wire holder spools 30, shown with sensor wire 24 wound thereon. The free ends of sensor wire 24 are passed over a pair of teflon wire guides 32 where the wire then is attached to second tape 22. The second tape 22 is a flat tape with a top and bottom, or front and back side, to both of which sides sensor wire 24 is attached. Sensor wire holder spools and teflon wire guides 32 are attached to support 34 which rotates in the direction of directional arrow 36.

Figure 3:
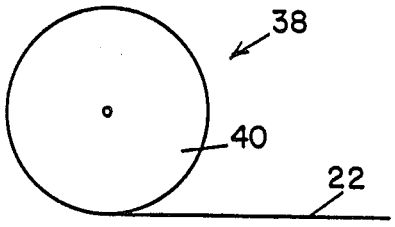
FIG. 3 is a top view of the secondary winder.

FIG. 3 illustrates a secondary tape winder 38 consisting of a single winding spool 40 around which is wrapped second tape 22. The free end of second tape 22 is passed to sensor wire dispenser 29, as shown in FIG. 2.

Figure 4:
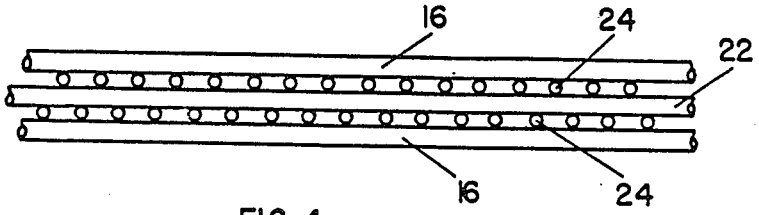
FIG. 4 is a side view of the sandwich made by the first and second tapes over the sensor wire.

FIG. 4 is a side view of the "sandwich" of the device wherein the construction of the invention is clearly shown. In the very center of the "sandwich" is second tape 22. Attached to either side of second tape 22 is sensor wire 24. Second tape 22 and sensor wires 24 are sandwiched in between two pieces of first tape 16. First tape 16, in the preferred embodiment, is 0.150 inches in width while second tape 22 is 0.125 inches in width. Further, both first tape 16 and second tape 22, in the preferred embodiment, are comprised of high temperature mylar tape products, one of which is a product produced by DuPont by the trade name of "kapton". Whatever high temperature tape is selected, it must be flexible but not stretchable.

Figure 5:
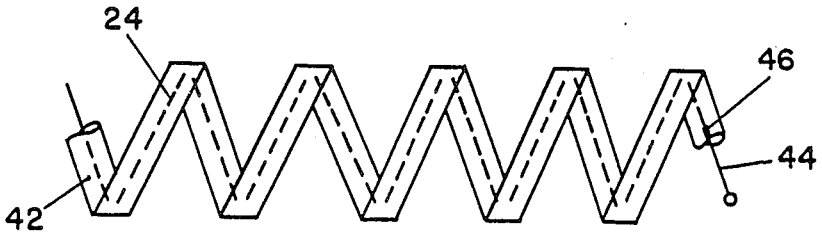
FIG. 5 is a side view of the strain-resistant RTD of the invention being pulled into a helical coil.

FIG. 5 is an illustration of one of the advantages of the invention. Shown in side view is a helical coil 42 of common design known in the art. Coil 42 is designed to shield sensor wire 24 from the material into which the sensor wire is introduced. Coil 42 is typically of some corrosion resistant plastic. Whether helical coil 42 is initially coiled, or uncoiled, introduction of a sensor wire is time consuming and difficult. Prior to the present invention, sensor wire 24 would often break during introduction of the wire into the coil 42. An important advantage of this invention is that sensor wires 24, sandwiched between two pieces of first tape 16 and attached to second tape 22, may actually be pulled into the plastic shield, coiled or uncoiled, by cable 44 attached at connection 46 to the end of first tape 16, second tape 22 and sensor wire 24.

Figure 6:
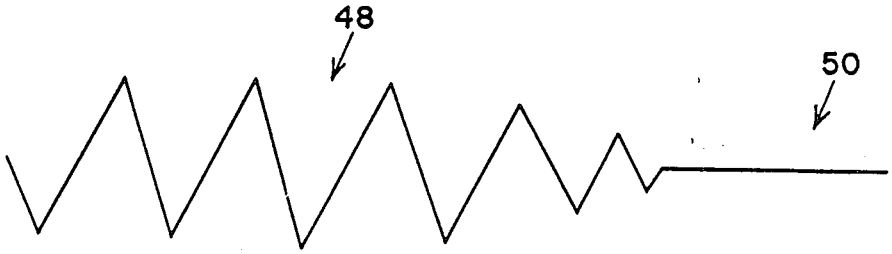
FIG. 6 is a side view of the strain-resistant RTD of the present invention in the bent or flexed position and the straight or stretched position.

FIG. 6 shows the sandwich of first tape 16, second tape 22 and sensor wire 24 inside coil 42 in the flexed position 48 and the stretched position 50. FIG. 6 also is demonstrative of the significant advantage of this invention over the prior art in light of the fact that sensor wire 24 has an extremely small diameter. This diameter typically may be as small as 0.002 inches. Further, the total length of the sensors used in the art may be in excess of 22 feet. As a result of the normal utilization of such sensor wire in a helical coil, such as coil 42, sensor wire 24 is often and continuously flexed and stretched as shown. By means of the illustrated embodiment of this invention herein, the resulting breakage of sensor wire 24, which presently occurs 100% of the time over relatively short periods of usage, can be dramatically and drastically reduced. The key is that sensor wires 24 are totally surrounded and attached to tapes 16 and 22. By their nature, tapes 16 and 22 are flexible but stretch resistant thereby enabling sensor wire 24 to flex but preventing sensor wire 24 from being broken by such flexing or stretching.

In operation, primary tape winder 12 is loaded with first tape 16 on spools 14. Slightly narrower second tape 22, of secondary tape winder 38, is wound around single winding spool 40. Annealed, bare platinum sensing wire 24 is loaded onto sensor wire holder spools 30 of sensor wire dispenser 29. The free ends of sensor wire 24 are passed around teflon wire guides 32 and directed to second tape 22 where a strand of sensor wire 24 is attached, by ordinary means known in the art and not discussed herein, to both sides of second tape 22. Once attached, tape 22 with sensor wire 24 on each side, is directed toward feed roller 26. At the same time, the free ends of first tape 16, from winding spools 14, are passed around initial tape guides 18 and additional tape guide 20 for proper alignment with second tape 22. As a result of the counter rotational direction, indicated by directional arrows 28 of feed rollers 26, first tape 16 is applied to the top and bottom of tape 22 with sensor wire 24 attached thereto. Consequently, a sandwich is created the center of which is second tape 22 with sensor wire 24 on each side, both sensor wires 24 being totally covered by somewhat wider first tape 16.

As a result, a flexible, non-stretchable strain-resistant resistance temperature detector is provided. Said detector may be pulled through standard plastic shields and or helical coils known in the art with confidence and ease and may be flexed repeatedly and often without breaking. Thus, the strain-resistant resistance temperature detector of the present invention has the important advantages of being extremely resistant to breakage while at the same time being flexible, while further being able to be pulled without breaking into position in the shielding coil known in the art.

While the present invention has been disclosed in connection with the preferred embodiment thereof, it should be understood that there may be other embodiments which fall within the spirit and scope of the invention as defined by the following claims.

What is claimed is:

1. An electrical resistance temperature element for use in a temperature averaging sensor comprising a length of wire with a known electrical resistance versus temperature characteristic wound on a first flexible, non-elastic substrate and further encapsulated by a second flexible non-elastic substrate.

2. The element of claim 1 wherein said length of wire is bifilaryly wound.

3. The element of claim 2 wherein said first and said second flexible, non-elastic substrate is a polyamid tape.

4. An electrical resistance temperature element for use in a temperature averaging sensor comprising:

A. a length of a flexible, substantially non-elastic secondary tape having a top side and a bottom side;

B. a first length of wire with a known electrical resistance versus temperature characteristic attached to said top side of said secondary tape such that a portion of said top side of said secondary tape extends beyond the sides of said first length of wire;

C. a second length of wire with a known electrical resistance versus temperature characteristic attached to said bottom side of said secondary tape such that a portion of said bottom side of said secondary tape extends beyond the sides of said second length of wire;

D. a first length of a flexible, substantially non-elastic primary tap affixed over said first length of wire and attached to said portion of said top side of said secondary tape extending beyond the side of said first length of wire; and E. a second length of a flexible, substantially non-elastic primary tape affixed over said second length of wire and attached to said portion of said bottom side of said secondary tape extending beyond the sides of said second length of wire.

5. The element of claim 4 wherein said first length of said primary tape and said second length of primary tape are of substantially equal width, said width being greater than the width of said secondary tape.

6. The element of claim 4 wherein the width portions of said first length of primary tape and said second length of primary tape extending beyond said width of said secondary tape are connected thereby encasing said secondary tape, said first length of wire, and said second length of wire.

7. The element of claim 4 wherein said wire is selected from a group of highly conductive metals including platinum.

8. The element of claim 4 wherein said primary and secondary tapes are selected from a group of highly pliable and stretch resistant material including plastic.

* * * * *

UNITED STATES PATENT AND TRADEMARK OFFICE

CERTIFICATE OF CORRECTION

PATENT NO. : 4,878,039

DATED : October 31, 1989

INVENTOR(S) : CAROLYN KRAEMER

It is certified that error appears in the above-identified patent and that said Letters Patent is hereby corrected as shown below:

Column 5, line 8, after the word "primary" delete "tap", and insert therefor --tape--

Signed and Sealed this

Sixth Day of August, 1991

*Attest:*

HARRY F. MANBECK, JR.

*Attesting Officer*

*Commissioner of Patents and Trademarks*